US007458840B2

(12) United States Patent
Pratt

(10) Patent No.: US 7,458,840 B2
(45) Date of Patent: Dec. 2, 2008

(54) CAP CONFIGURED TO REMOVABLY CONNECT TO AN INSULATION DISPLACEMENT CONNECTOR BLOCK

(75) Inventor: Jerome A. Pratt, Georgetown, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 42 days.

(21) Appl. No.: 11/296,945

(22) Filed: Dec. 8, 2005

(65) Prior Publication Data

US 2006/0089040 A1 Apr. 27, 2006

Related U.S. Application Data

(63) Continuation-in-part of application No. 10/941,441, filed on Sep. 15, 2004.

(51) Int. Cl.
*H01R 4/24* (2006.01)

(52) U.S. Cl. ..... 439/409

(58) Field of Classification Search ..... 439/404–417, 439/392; 16/292, 308
See application file for complete search history.

(56) References Cited

U.S. PATENT DOCUMENTS

| | | | | |
|---|---|---|---|---|
| 1,274,137 | A * | 7/1918 | Carrol | 242/596.2 |
| 2,948,486 | A * | 8/1960 | Epeneter | 242/596.4 |
| 3,596,232 | A * | 7/1971 | Medley | 439/410 |
| 3,617,983 | A | 11/1971 | Patton | |
| 3,621,117 | A | 11/1971 | Antas et al. | |
| 3,634,604 | A | 1/1972 | Dola | |
| 3,702,456 | A | 11/1972 | Patton | |
| 3,708,779 | A | 1/1973 | Enright et al. | |
| 3,845,455 | A | 10/1974 | Shoemaker | |
| 3,854,114 | A | 12/1974 | Kloth et al. | |
| 3,878,998 | A * | 4/1975 | Lazzari | 242/596.4 |
| 3,937,545 | A | 2/1976 | Cairns et al. | |
| 4,017,140 | A | 4/1977 | Reavis, Jr. et al. | |
| 4,046,446 | A | 9/1977 | Reavis, Jr. | |
| 4,127,312 | A | 11/1978 | Fleischhacker et al. | |
| 4,192,570 | A | 3/1980 | Van Horn | |
| 4,214,805 | A | 7/1980 | Faulconer | |
| 4,326,767 | A | 4/1982 | Silbernagel et al. | |

(Continued)

FOREIGN PATENT DOCUMENTS

DE 33 13 654 A1 10/1984

(Continued)

OTHER PUBLICATIONS 3M 4500 Modular Terminating System, Technical Report, Oct. 1993, 20 pages, 3M Telecom and Visual Systems Group, Austin, Texas 78726.

(Continued)

*Primary Examiner*—Renee S Luebke
*Assistant Examiner*—Larisa Z Tsukerman
(74) *Attorney, Agent, or Firm*—Janet A. Kling

(57) ABSTRACT

A cap including a width and configured to removably connect to an insulation displacement connector (IDC) block includes a body and a projection extending from the body. The projection is configured to engage with an aperture in the IDC block. At least one of the body or the first projection may be manipulated in order to adjust the width of the cap.

23 Claims, 10 Drawing Sheets

U.S. PATENT DOCUMENTS

| | | | | | |
|---|---|---|---|---|---|
| 4,444,447 | A | | 4/1984 | Markwardt | |
| 4,508,411 | A | | 4/1985 | Hughes et al. | |
| 4,522,459 | A | | 6/1985 | Hardesty et al. | |
| 4,533,196 | A | | 8/1985 | Forberg et al. | |
| 4,541,679 | A | | 9/1985 | Fiedler et al. | |
| 4,552,429 | A | | 11/1985 | van Alst | |
| 4,553,710 | A | * | 11/1985 | Pool | 242/596.4 |
| 4,614,312 | A | * | 9/1986 | Del Pino | 242/596.4 |
| 4,679,881 | A | | 7/1987 | Galvin et al. | |
| 4,795,363 | A | | 1/1989 | Scherer et al. | |
| 4,815,988 | A | | 3/1989 | Scherer | |
| 4,842,546 | A | * | 6/1989 | Song | 439/409 |
| 4,875,875 | A | * | 10/1989 | Archer et al. | 439/401 |
| 4,932,894 | A | | 6/1990 | Scherer | |
| 4,988,311 | A | * | 1/1991 | Tanzola | 439/404 |
| 4,995,829 | A | | 2/1991 | Geib et al. | |
| 5,092,792 | A | | 3/1992 | Nilsson | |
| 5,127,845 | A | | 7/1992 | Ayer et al. | |
| 5,139,440 | A | | 8/1992 | Volk et al. | |
| 5,178,558 | A | | 1/1993 | Knox et al. | |
| 5,195,907 | A | | 3/1993 | Urban | |
| 5,199,899 | A | | 4/1993 | Ittah | |
| 5,281,163 | A | | 1/1994 | Knox et al. | |
| 5,281,164 | A | * | 1/1994 | Gan | 439/409 |
| 5,295,857 | A | | 3/1994 | Toly | |
| 5,338,220 | A | | 8/1994 | Soes et al. | |
| 5,360,352 | A | * | 11/1994 | Rudy et al. | 439/469 |
| 5,435,747 | A | | 7/1995 | Franckx et al. | |
| 5,449,299 | A | | 9/1995 | Shimirak et al. | |
| 5,453,024 | A | * | 9/1995 | Patinier | 439/410 |
| 5,498,174 | A | | 3/1996 | Speer et al. | |
| 5,504,654 | A | | 4/1996 | Knox et al. | |
| 5,549,489 | A | | 8/1996 | Baggett et al. | |
| RE35,325 | E | | 9/1996 | Wass et al. | |
| 5,551,889 | A | | 9/1996 | Kozel et al. | |
| 5,556,296 | A | | 9/1996 | Dussausse et al. | |
| 5,575,689 | A | | 11/1996 | Baggett et al. | |
| 5,640,690 | A | * | 6/1997 | Kudrna | 455/575.3 |
| 5,664,963 | A | | 9/1997 | Yamamoto et al. | |
| 5,667,402 | A | * | 9/1997 | Denovich et al. | 439/409 |
| 5,681,182 | A | * | 10/1997 | Reichle | 439/417 |
| 5,683,268 | A | | 11/1997 | Drach et al. | |
| 5,697,124 | A | * | 12/1997 | Jung | 16/341 |
| 5,745,567 | A | * | 4/1998 | Middleton | 379/433.13 |
| 5,762,518 | A | | 6/1998 | Tanigawa et al. | |
| 5,785,548 | A | * | 7/1998 | Capper et al. | 439/409 |
| 5,797,759 | A | | 8/1998 | Mattis et al. | |
| 5,836,791 | A | | 11/1998 | Waas et al. | |
| 5,939,672 | A | * | 8/1999 | Tang | 174/50.5 |
| 5,944,559 | A | | 8/1999 | Wu | |
| 5,947,761 | A | * | 9/1999 | Pepe | 439/409 |
| 5,961,341 | A | | 10/1999 | Knowles et al. | |
| 5,967,826 | A | | 10/1999 | Letailleur | |
| 6,015,312 | A | | 1/2000 | Escane | |
| 6,056,584 | A | | 5/2000 | Daoud | |
| 6,070,821 | A | * | 6/2000 | Mitchell | 242/160.4 |
| 6,082,664 | A | * | 7/2000 | Phelps et al. | 242/596.5 |
| 6,089,902 | A | | 7/2000 | Daoud | |
| 6,092,758 | A | * | 7/2000 | Gemmell | 242/596.4 |
| 6,099,343 | A | | 8/2000 | Bonvallat et al. | |
| 6,152,760 | A | | 11/2000 | Reeser | |
| 6,159,036 | A | | 12/2000 | Daoud | |
| 6,188,560 | B1 | | 2/2001 | Waas | |
| 6,193,556 | B1 | | 2/2001 | Escane | |
| 6,222,717 | B1 | | 4/2001 | Waas et al. | |
| 6,254,420 | B1 | | 7/2001 | Letailleur et al. | |
| 6,254,421 | B1 | | 7/2001 | Denovich et al. | |
| 6,386,478 | B2 | * | 5/2002 | Reilly | 242/596.4 |
| 6,406,324 | B1 | | 6/2002 | Duesterhoeft et al. | |
| 6,582,247 | B2 | | 6/2003 | Siemon | |
| 6,604,956 | B2 | | 8/2003 | Ruiz et al. | |
| 6,607,160 | B2 | * | 8/2003 | Lewis et al. | 242/564.4 |
| 6,655,981 | B2 | | 12/2003 | Seki | |
| 6,676,430 | B1 | | 1/2004 | Conorich | |
| 6,811,430 | B1 | | 11/2004 | Carrico et al. | |
| 6,859,978 | B2 | * | 3/2005 | Pan | 16/292 |
| 6,893,280 | B2 | | 5/2005 | Thompson et al. | |
| 7,101,216 | B2 | | 9/2006 | Fasce et al. | |
| 7,223,117 | B2 | | 5/2007 | Pratt | |
| 2002/0094715 | A1 | | 7/2002 | Pepe et al. | |
| 2003/0049961 | A1 | | 3/2003 | Tricaud et al. | |
| 2003/0156389 | A1 | | 8/2003 | Busse et al. | |
| 2003/0184204 | A1 | * | 10/2003 | McCoy et al. | 313/318.12 |
| 2006/0063417 | A1 | * | 3/2006 | Liu et al. | 439/404 |
| 2006/0264090 | A1 | | 11/2006 | Dower et al. | |
| 2006/0264117 | A1 | | 11/2006 | Hills et al. | |
| 2007/0004272 | A1 | | 1/2007 | Pratt | |
| 2007/0020988 | A1 | * | 1/2007 | Frenken | 439/404 |

FOREIGN PATENT DOCUMENTS

| | | | |
|---|---|---|---|
| DE | 43 19 565 | C1 | 7/1994 |
| EP | 0 073 740 | B1 | 6/1985 |
| EP | 0 220 884 | A2 | 5/1987 |
| EP | 0 310 339 | | 4/1989 |
| EP | 0 271 413 | B1 | 5/1992 |
| EP | 0 718 915 | B1 | 7/1997 |
| EP | 0 878 866 | | 11/1998 |
| FR | 2 730 096 | A1 | 8/1996 |
| GB | 2 129 628 | A | 5/1984 |
| GB | 2 149 231 | A | 6/1985 |
| GB | 2 293 696 | A | 4/1996 |
| WO | WO 99/04454 | | 1/1999 |
| WO | WO 99/04455 | | 1/1999 |
| WO | WO 01/57957 | A1 | 8/2001 |

OTHER PUBLICATIONS

U.S. Appl. No. 29/213197, filed Sep. 15, 2004, entitled "Cap for Electrical Connector".

* cited by examiner

CAP CONFIGURED TO REMOVABLY CONNECT TO AN INSULATION DISPLACEMENT CONNECTOR BLOCK

CROSS-REFERENCE TO RELATED APPLICATION

The present application is a continuation-in-part of U.S. patent application Ser. No. 10/941,441, entitled "CONNECTOR ASSEMBLY FOR HOUSING INSULATION DISPLACEMENT ELEMENTS," and filed on Sep. 15, 2004 by Jerome Pratt, Xavier Fasce, and Guy Metral.

FIELD

The present invention relates to insulation displacement connectors. In one particular aspect, the present invention relates to a cap configured to removably attach to an insulation displacement connector block.

BACKGROUND

In a telecommunications context, connector blocks are connected to cables that feed subscribers while other connector blocks are connected to cables to the central office. To make the electrical connection between the subscriber block and the central office block, jumper wires are inserted to complete the electrical circuit. Typically jumper wires can be connected, disconnected, and reconnected several times as the consumer's needs change.

An insulation displacement connector, or IDC, element is used to make the electrical connection to a wire or electrical conductor. The IDC element displaces the insulation from a portion of the electrical conductor when the electrical conductor is inserted into a slot within the IDC element so the IDC element makes electrical connection to the electrical conductor. Once the electrical conductor is inserted within the slot with the insulation displaced, electrical contact is made between the conductive surface of the IDC element and the conductive core of the electrical conductor.

Typically the IDC element is housed in an insulated housing. Often, the housing has a cap (also referred to as an "access cover") or other moveable member that is movable to press the electrical conductor into contact with the IDC element. Typically, when inserting the electrical conductor in the housing, the cap closes and the user is then unable to visually verify that the electrical conductor made a proper connection with the IDC element. The user then may not be sure whether an effective connection has been made between the electrical conductor and the IDC element.

Another problem associated with connection devices is that inserting the electrical conductor into the IDC element slot often requires a significant force, which may require the use of special tools or devices. Often the cap is adapted to be used as the insertion device for inserting the electrical conductors into the IDC element slots. However, closing the cap to insert the electrical conductor into the IDC element slot may require a significant force and may strain the user's finger or hand.

BRIEF SUMMARY

In a first aspect, the present invention provides a cap configured to connect to an insulation displacement connector (IDC) block. The cap has a width and comprises a body including a pivot portion and a cover portion, and a first projection attached to the body and configured to engage with a first aperture in the IDC block. At least one of the body or the first projection may be manipulated in order to adjust the width of the cap.

In a second aspect, the present invention provides a cap configured to connect to an insulation displacement connector (IDC) block. The cap comprises a body and a projection extending from the body. The body includes a pivot portion and a cover portion, where the pivot portion is configured to pivotally mount to the IDC block. The projection is movable with respect to the body, and is configured to engage with a first aperture in the IDC block.

In a third aspect, the present invention provides an insulation displacement connector (IDC) block including a housing and a cap removably connected to the housing. The housing includes a cavity for receiving an IDC element and a wall, where the wall defines a part of the cavity and includes an aperture. The cap includes a body including a pivot portion and a cover portion, and a projection attached to the body. At least one of the body or the first projection may be manipulated in order to adjust a width of the cap.

In a fourth aspect, the present invention provides a kit comprising components for assembly into an insulation displacement connector (IDC) block. The kit comprises caps configured to pivotally connect to the IDC block. A first modular cap comprises a first body and first means connected to the first body for pivotally connecting the first body to the IDC block, where the first means is configured to engage the IDC block. A second modular cap is similar to the first modular cap and comprises a second body and second means connected to the second body for pivotally connecting the second body to the IDC block, where the second means is configured to engage the IDC block. After the first modular cap is connected to the IDC block, the first modular cap is capable of being detached from IDC block by disengaging the first means for pivotally connecting the first body to the IDC block from the IDC block. The second modular cap is capable of subsequently being connected to the IDC block by engaging the second means for pivotally connecting the second body to the IDC block with the IDC block.

In a fifth aspect, the present invention provides a method of replacing a first cap pivotally connected to an insulation displacement connector (IDC) block, where the first cap includes a first body and first means for pivotally connecting the first body to the IDC block, and where the first means is connected to the first body and engages with the IDC block. The method comprises removing the first cap by disengaging the first means for pivotally connecting the first body to the IDC block from the IDC block, thereby resulting in a void in the IDC block. The method further comprises subsequently connecting a second cap to the IDC block. The second cap includes a second body and second means for pivotally connecting the second body to the IDC block, where the second means is connected to the second body and is configured to engage with the IDC block. The second cap is connected to the IDC block by engaging the second means for pivotally connecting the second body to the IDC block with the IDC block, where the second cap is positioned in the void.

The above summary is not intended to describe each disclosed embodiment or every implementation of the present invention. The figures and the detailed description presented below more particularly exemplify illustrative embodiments of the invention.

While the above-identified figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the spirit and scope of the principals of this invention. The figures may not be drawn to scale. Like reference numbers have been used throughout the figures to denote like parts.

DETAILED DESCRIPTION

Figure 1:
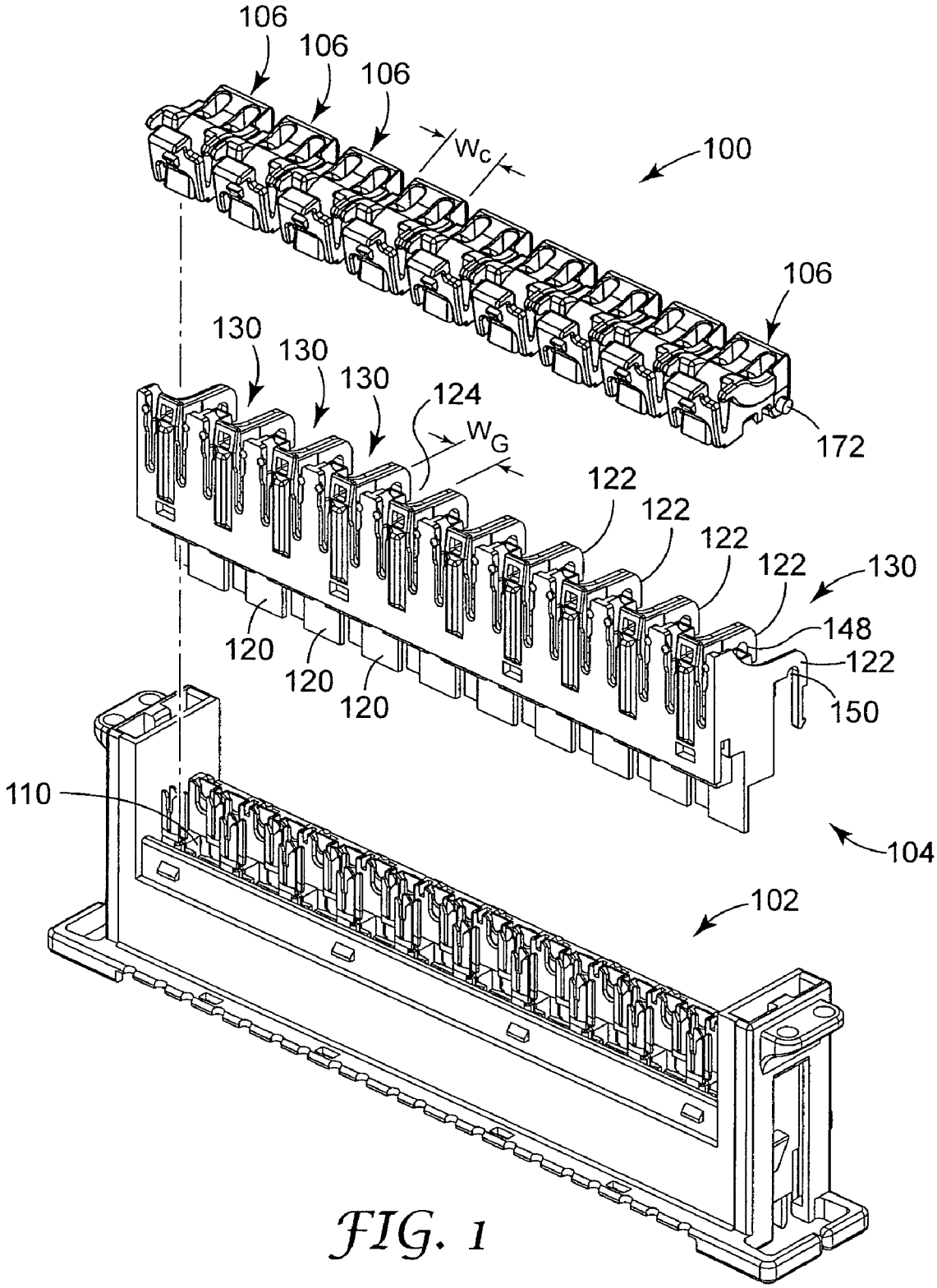
FIG. 1 is an exploded perspective view of a connector assembly of the present invention.

FIG. 1 is an exploded perspective view of an insulation displacement connector assembly 100 of the present invention. The connector assembly 100 comprises a base unit 102, a connector unit 104, and a plurality of caps 106. In FIG. 1, the connector assembly 100 is shown disassembled. To assemble the connector assembly 100, the caps 106 are inserted in between lock projections 122 projecting from a rear side of the connector unit 104 and then the connector unit 104 is placed over and slid into the base unit 102. In an alternate embodiment, the caps 106 are connected to the connector unit 104 after the connector unit 104 is attached to the base unit 102. This allows one or more caps 106 to be replaced after the connector assembly 100 is assembled.

The base unit 102 comprises an insulated housing with a series of receiving slots 110 for connection with the connector unit 104. Lock slots on a rear side of the base unit 102 receive lock projections 122 of the connector unit 104 to lock the connector unit 104 to the base unit 102.

Figure 11:
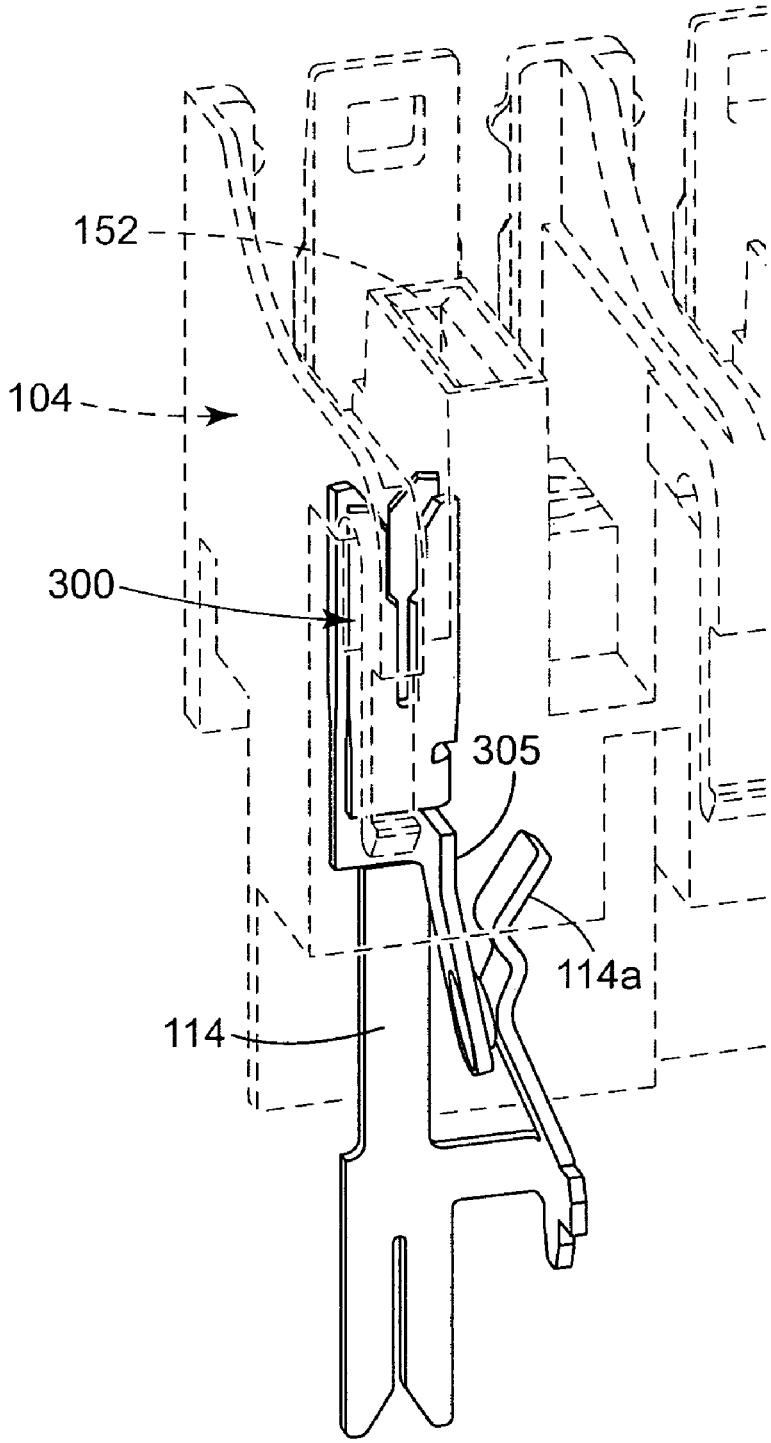
FIG. 11 is a perspective view through the connector unit (shown in phantom) showing the connection between the insulation displacement element and an electrical element.
Figure 12:
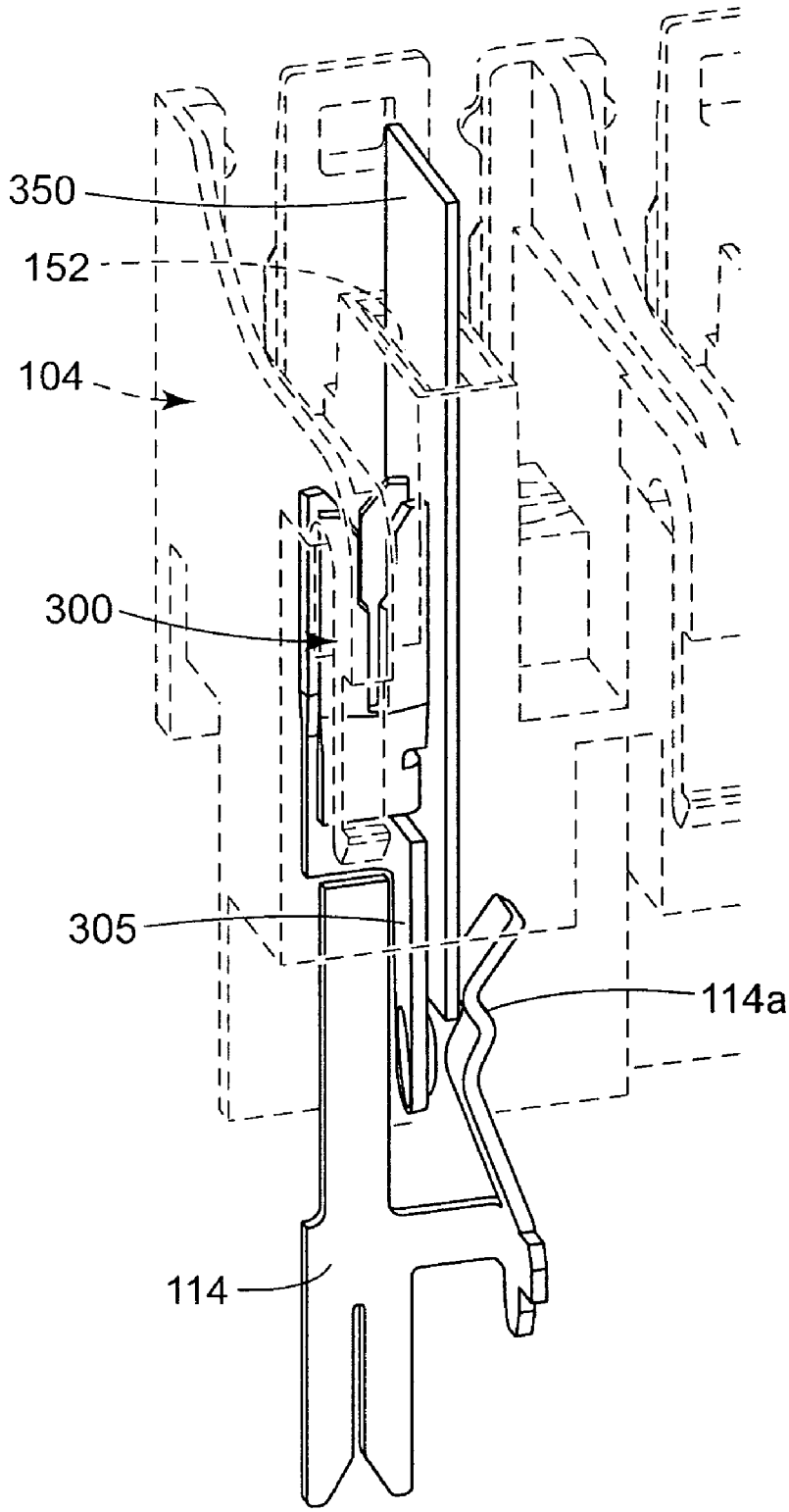
FIG. 12 is a perspective view through the connector unit (shown in phantom) showing a test probe inserted between the connection of the insulation displacement element and an electrical element.

Located within the base unit 102 are a plurality of electrical elements 114 (see FIGS. 11 and 12). Each electrical element 114 is in the form of an IDC element, and is adapted to make electrical contact with a corresponding IDC element in the connector assembly 100, as explained below.

The connector unit 104 comprises an insulated housing with a series of alignment projections 120 for connection into the receiving slots 110 of the base unit 102. The lock projections 122 project outwardly and downwardly from the rear side of the connector unit 104 and lock within the lock slots on the rear side of the base unit 102 to lock the connector unit 104 to the base unit 102.

Each cap 106 is independently pivotally mounted onto the connector unit 104, relative to a respective housing 130. Each cap 106 comprises a first pivot projection (a "pivot projection" may also referred to as a "pin") 170 and a second coaxial pivot projection 172 (shown in FIG. 3A) opposite the first pivot projection 170, which enter and engage with the connector unit 104 at a gap 124 created between adjacent lock projections 122, as they project outwardly and downwardly from the rear side of the connector unit 104. For assembly, the pivot projections 170, 172 of the cap 106 are first inserted within the gap 124 and connected to the connector unit 104 prior to the connector unit 104 being attached to the base unit 102. Once the connector unit 104 is attached and locked within the base unit 102, the first and second pivot projections 170, 172 of the cap 106 are secured within hinge slots 148, 150, respectively, on adjacent lock projections 122, and within the gap 124 to prevent the cap 106 from being removed. However, the pivot projections 170, 172 allow for pivoting movement of the cap 106 relative to the connector unit 104, within the hinge slots 148, 150.

In the alternate embodiments of suitable caps 107 (FIG. 3B), 108 (FIG. 3C), and 109 (FIG. 3D) that may be incorporated into the connector assembly 100 in place of the caps 106, the caps 107, 108 and 109 are configured to connect to the connector unit 104 after the connector unit 104 is attached to the base unit 102. In each of the alternate embodiments, the pivot projections and/or the cover portion of the cap may be manipulated in order to change a width $W_C$ of the cap. Width $W_C$ of the cap is a width of the cap at its widest portion, and so width $W_C$ can be designated the "greatest width" of the cap. In the embodiment of the cap 106 shown in FIG. 1, the greatest width $W_C$ of the cap occurs at the pivot portion 166 of the cap 106, where the first and second pivot projections 170 and 172 extend from the pivot portion 166. The extension of the first pivot projection 170 and second coaxial pivot projection 172 from the cap 106 causes the width $W_C$ of the cap 106 to be greater than the width $W_G$ of the gap 124. The cap 106 is not configured to allow a user to adjust the width $W_C$ of the cap 106. As a result, the cap 106 may not be connected to the connector unit 104 after the connector unit is attached to the base 102 because the cap 106 will not fit within the gap 124. The cap 106 is therefore connected to the connector unit 104 before the connector unit 104 is attached to the base 102.

In general, in order for a cap to fit within the gap 124 created between adjacent lock projections 122 (shown in FIG. 1), the greatest width $W_C$ of the cap should be minimized to be less than or equal to a width $W_G$ of the gap 124 (shown in FIG. 1). Each one of the alternate caps 107, 108, and 109 includes a means for allowing the first and second pivot projections to move inward from an original position in order to temporarily adjust a greatest width $W_C$ of each of the caps 107, 108, and 109. In each of the alternate caps 107, 108, and 109, the first and second pivot projections are able to return to their original positions after the caps 107, 108, and 109 are connected to the connector unit 104. These alternate embodiments, which allow connection of each cap 107, 108, 109 to the connector unit 104 after the connector unit 104 is attached to the base 102, are described in reference to FIGS. 3B-3D.

The connector unit 104 shown in FIG. 1 comprises a plurality of housings 130 and associated caps 106. A separate cap 106 is provided to cover each housing 130. Each connector assembly 100 is a self-contained unit, insulated from the next adjacent assembly 100. However, the connector assembly 100 may comprise any number of housings 130, base units 102, and caps 106. Each housing 130, base unit 102 and cap 106 form an assembly that is adapted to receive at least one pair of electrical conductors, as explained below. Because the connector assembly 100 may comprise any number of housings 130, base units 102, and caps 106 there can be any number of a pair of electrical conductors, such as but not limited to one, 5, 10, or 50 pairs.

The connector assembly 100 may be constructed, for example, of an engineering plastic such as, but not limited to: Valox® 325 a polybutylene terephthalate (PBT) polymer, available from GE Plastics of Pittsfield, Mass.; Lexan® 500R a polycarbonate resin, flame retardant, 10% glass fiber reinforced grade available from GE Plastics of Pittsfield, Mass.; Mackrolon® 9415 a polycarbonate resin, flame retardant, 10% glass fiber reinforced grade available from Bayer Plastics Division of Pittsburgh, Pa.; or Mackrolon® 9425 a polycarbonate resin, flame retardant, 20% glass fiber reinforced grade available from Bayer Plastics Division of Pittsburgh, Pa.

The caps 106 may be constructed, for example, of an engineering plastic such as, but not limited to: Ultem® 1100 a polyether imide resin available from GE Plastics of Pittsfield, Mass.; Valox® 420 SEO a polybutylene terephthalate (PBT) resin flame retardant, 30% glass fiber reinforced available from GE Plastics of Pittsfield, Mass.; IXEF® 1501 a polyarylamide resin, flame retardant, 30% glass fiber reinforced grade available from Solvay Advanced Polymers, LLC of Alpharetta, Ga.; or IXEF® 1521 a polyarylamide resin, flame retardant, 50% glass fiber reinforced grade available from Solvay Advanced Polymers, LLC of Alpharetta, Ga.

Figure 2:
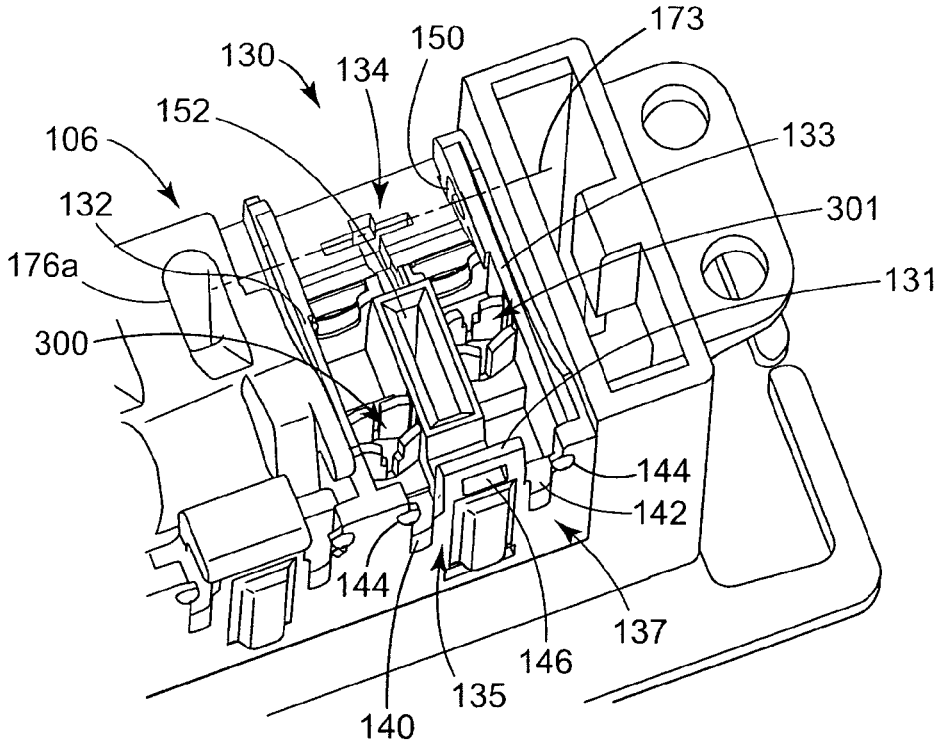
FIG. 2 is an assembled perspective view of a portion of the connector assembly of the present invention, with one of a plurality of pivoting caps removed for clarity of illustration.

FIG. 2 is an assembled perspective view of a portion of the connector assembly 100 of the present invention, with one of the pivoting caps 106 omitted to show the internal configuration and components of one of the housings 130. Also, electrical conductors (i.e., wires), which would otherwise be in the housing 130 when fully assembled for operation, have been omitted to show the internal configuration and components of the housing 130.

Each housing 130 comprises a front wall 131, a first sidewall 132, a second sidewall 133, and a base 134. The housing 130 is formed to have a first section 135 and a second section 137. Separating the first section 135 from the second section 137 is a test probe slot 152.

Figure 3A:
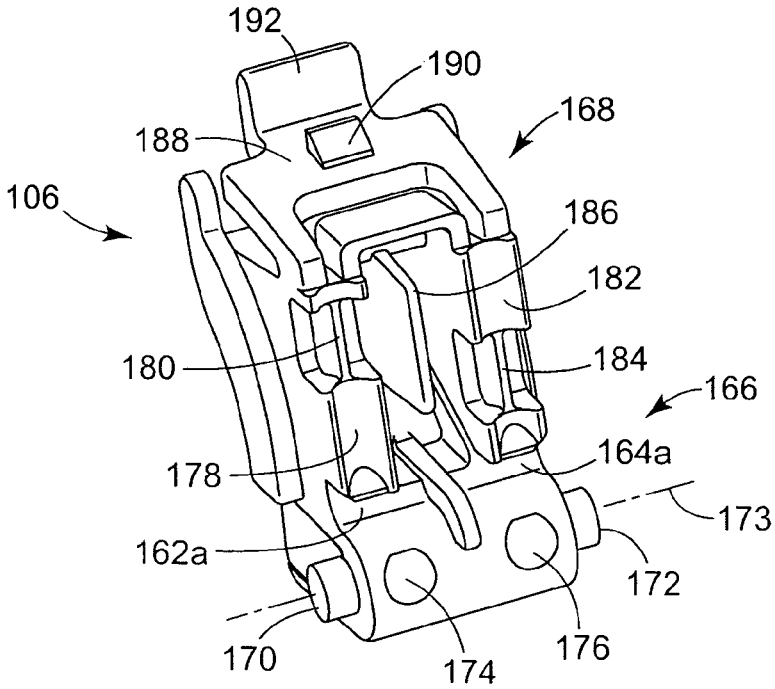
FIG. 3A is a perspective view of the underside of one of the caps.
Figure 4:
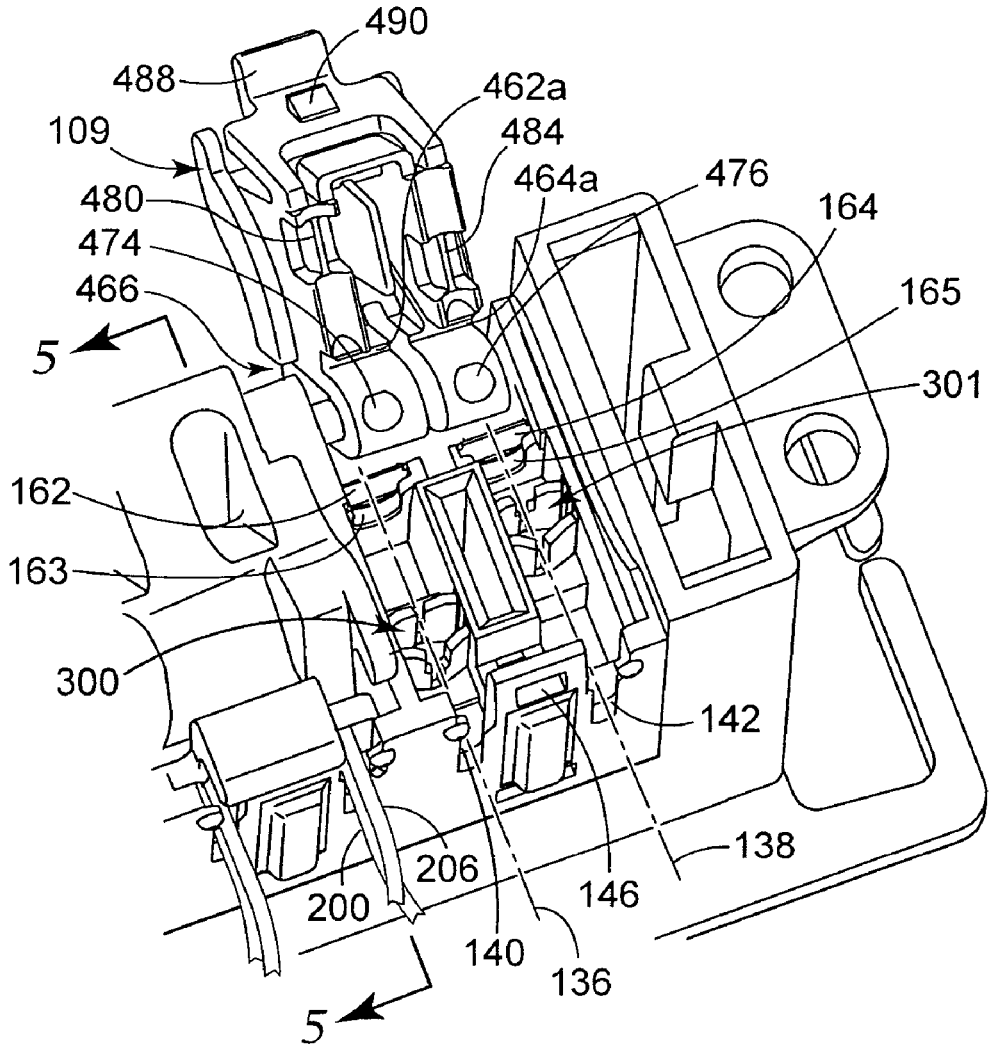
FIG. 4 is a perspective view of a portion of the assembled connector unit, showing one of the caps in a pivoted open position relative to a housing.

Along the front wall 131 is a first wire groove 140 and a second wire groove 142, which allow entry of the electrical conductors into the housing 130 (see FIG. 4). Wire retainer projections 144 extend laterally into the grooves 140 and 142 to resiliently hold the electrical conductors within the first wire groove 140 and second wire groove 142, and prevent the electrical conductors from moving out of the open ends of the grooves 140, 142. A latch opening 146 is also disposed on the front wall 132, which is capable of receiving a latch projection 190 (see FIG. 3A) on the cap 106 to lock the cap 106 to the front wall 132 of the housing 130 and prevent the cap 106 from accidentally opening (see FIG. 4).

Along the first side wall 132 is a first hinge slot 148 (which may also be referred to as a "first aperture"), and along the second side wall 133 is a second hinge slot 150 (which may also be referred to as a "second aperture"). See FIGS. 1 and 2. Each hinge slot 148, 150 is created by a portion of the gap 124 of the lock projections 122 extending out and down from the housing 130. The hinge slots 148, 150 pivotally receive the pivot projections 170, 172 extending laterally from the cap 106, to allow the cap 106 to pivot along a pivot axis 173 (see FIGS. 2 and 3).

The base 134 of the housing 130 includes the test probe slot 152, which essentially separates the first section 135 of the housing 130 from the second section 137 of the housing 130. The test probe slot 152 may be divided into two portions with the first allowing for testing of the electrical connections on the first section 135 of the housing 130 and the second allowing for testing of the electrical connections on the second section 137 of the housing 130. Test probes as are known in the art are inserted into the test probe slot 152 (see, e.g., FIG. 12).

As seen in FIG. 2, extending from the base 134 of the first section 135 of the housing 130 is a first IDC element 300, and extending from the base 134 of the second section 137 of the housing 130 is a second IDC element 301. Each IDC element 300, 301 is conductive and capable of displacing the insulation from electrical conductors to electrically couple the conductive cores of the electrical conductors to the IDC elements. For example, the IDC elements 300, 301 may be constructed of phosphor bronze alloy C51000 per ASTM B103/103M-98e2 with reflowed matte tin plating of 0.000150-0.000300 inches thick, per ASTM B545-97 (2004)e2 and electrodeposited nickel underplating, 0.000050 inches thick minimum, per SAE-AMS-QQ-N-290 (July 2000).

FIG. 3A is a perspective view of the underside of the cap 106. The cap 106 includes a pivot portion 166 and a cover portion 168. Extending laterally from the pivot portion 166 are the first pivot projection 170 and second pivot projection 172. The pivot projections 170, 172 engage with the hinge slots 148, 150 of the side walls 132, 133 of the housing 130 to secure the cap 106 to the housing 130 while allowing for pivoting movement of the cap 106 along the pivot axis 173.

Extending into the pivot portion 166 is a first recess 174 and second recess 176. The recesses 174, 176 may be a through hole extending through the entire pivot portion 166 of the cap 106, or may extend through only a portion of the pivot portion 166 of the cap 106. The first recess 174 is aligned with the first section 135 of the housing 130, and the second recess 176 is aligned with the second section 137 of the housing 130. Each recess 174, 176 receives electrical conductors passing through the housing 130. Although the first recess 174 and second recess 176 are shown as parallel recesses through the pivot portion 166, it is within the scope of the present invention that the first recess 174 and second recess 176 may not be parallel to one another.

Figure 6:
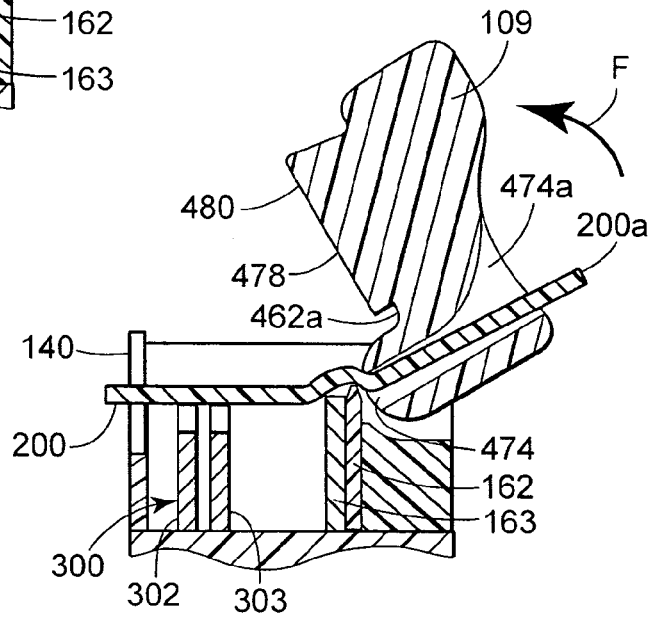
FIG. 6 is a schematic sectional view through the connector unit of FIG. 4, with the electrical conductor inserted through the recess in the cap and the cap in a partially closed position relative to the housing.

The cover portion 168 of the cap 106 is moveable from an open position (FIG. 4) to a closed position (e.g., FIG. 7) to cover the open top of the housing 130. Adjacent the pivot portion 166 of the cap is a first indent 162*a* and a second indent 164*a*. A first wire hugger 178 and a first wire stuffer 180 are located on the cover portion 168, adjacent the first section 135 of the housing 130. A second wire stuffer 184 and a second wire hugger 182 are located on the cover portion 168 adjacent the second section 137 of the housing 130. When the cap 106 is closed, the underside of the cover portion 168 of the cap 106 engages the electrical conductor. The first wire hugger 178 and first wire stuffer 180 engage an upper exposed surface of the electrical conductor. Upon complete closure of the cap 106, the first wire stuffer 180 (being aligned with a first IDC element 300) follows and pushes the electrical conductor into the first IDC element 300. (FIG. 6). A similar closing occurs at the second IDC element 301. However, because the second IDC element 301 is closer to the pivot axis 173 of the pivot portion 166 of the cap 106, the second wire stuffer 184 is arranged on the cap 106 accordingly (i.e., the positions of the wire stuffers 180 and 184 are staggered radially relative to the pivot axis 173). The overall length of the wire stuffers 180,184 may be uniform or may be different from one another depending on the sequencing desired for pushing the electrical conductors into the IDC elements 300, 301. Extending through the center of the cover portion 168 is a test probe slot cap 186, which partially enters the test probe slot 152 when the cap 106 is closed.

A resilient latch 188, which is capable of flexing relative to the cover portion 168 of the cap 106, is located on the cover portion 168 of the cap 106. When the cap 106 is closed, the resilient latch 188 flexes so that the latch projection 190 on the resilient latch 188 can enter the latch opening 146 on the front wall 131 of the housing 130. When the latch projection 190 is engaged with the latch opening 146, the cap 106 is secured to the housing 130 and will not open. To open the cap 106, a release lever 192 on the resilient latch 188 is pressed rearwardly to disengage the latch projection 190 from the latch opening 146. Then, the cap 106 can be pivoted open, as shown in FIG. 4, for access to the cavity within the housing 130 and electrical conductors and IDC elements therein.

In some circumstances, it may be desirable to replace one or more caps 106 after the connector assembly 100 is assembled. For example, after the connector assembly 100 is assembled and mounted in a central location (e.g., a telecommunications closet, an outdoor cabinet, an aerial terminal or closure, or other common use application), at least a part of one or more caps 106 may become damaged from wear and tear, from the latch 188 being broken off, or otherwise. If a cap 106 is damaged, the respective housing 130 may become exposed to environmental debris, and other functional aspects of the cap 106 may be affected. Rather than rendering a part of the connector assembly 100 unusable because of a damaged cap 106, a cap in accordance with the alternate embodiments of the present invention may be removably attached to the connector unit 104, enabling the cap to be detached from the connector unit 104 and replaced by another cap. Of course, a cap may be removed and/or replaced for reasons other than damage to the cap itself.

Figure 3B:
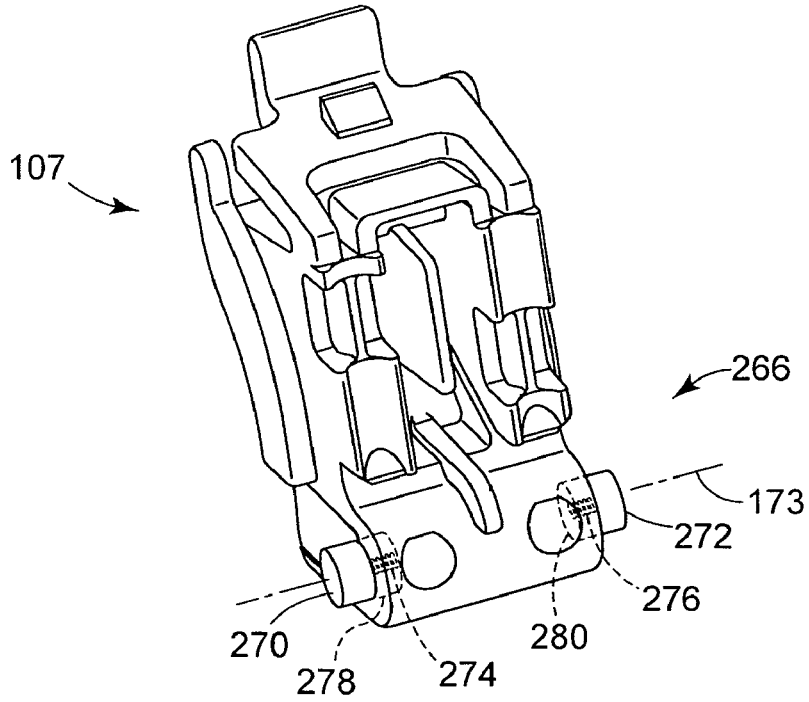
FIG. 3B is a perspective view of the underside of a first alternate embodiment of a cap.
Figure 3C:
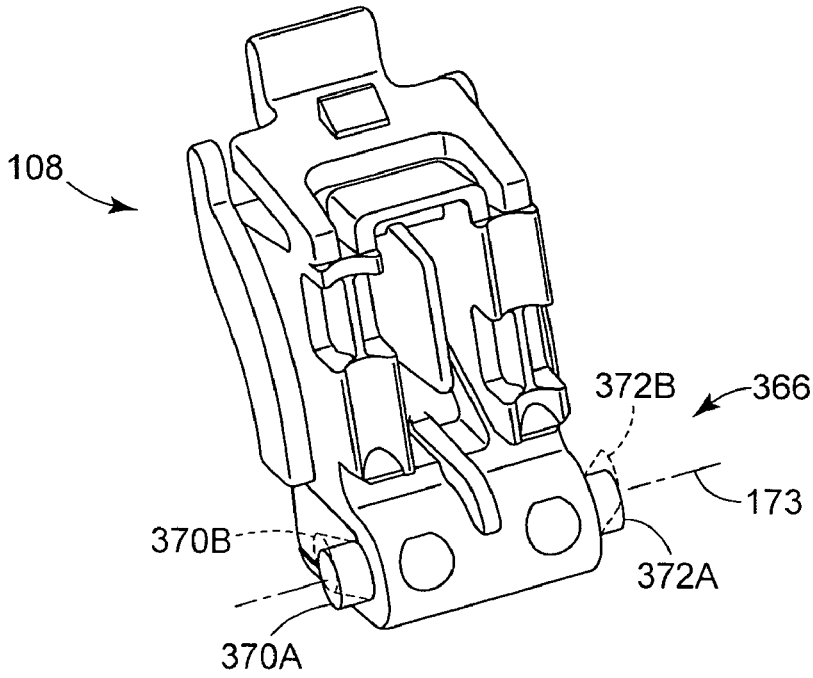
FIG. 3C is a perspective view of the underside of a second alternate embodiment of a cap.
Figure 3D:
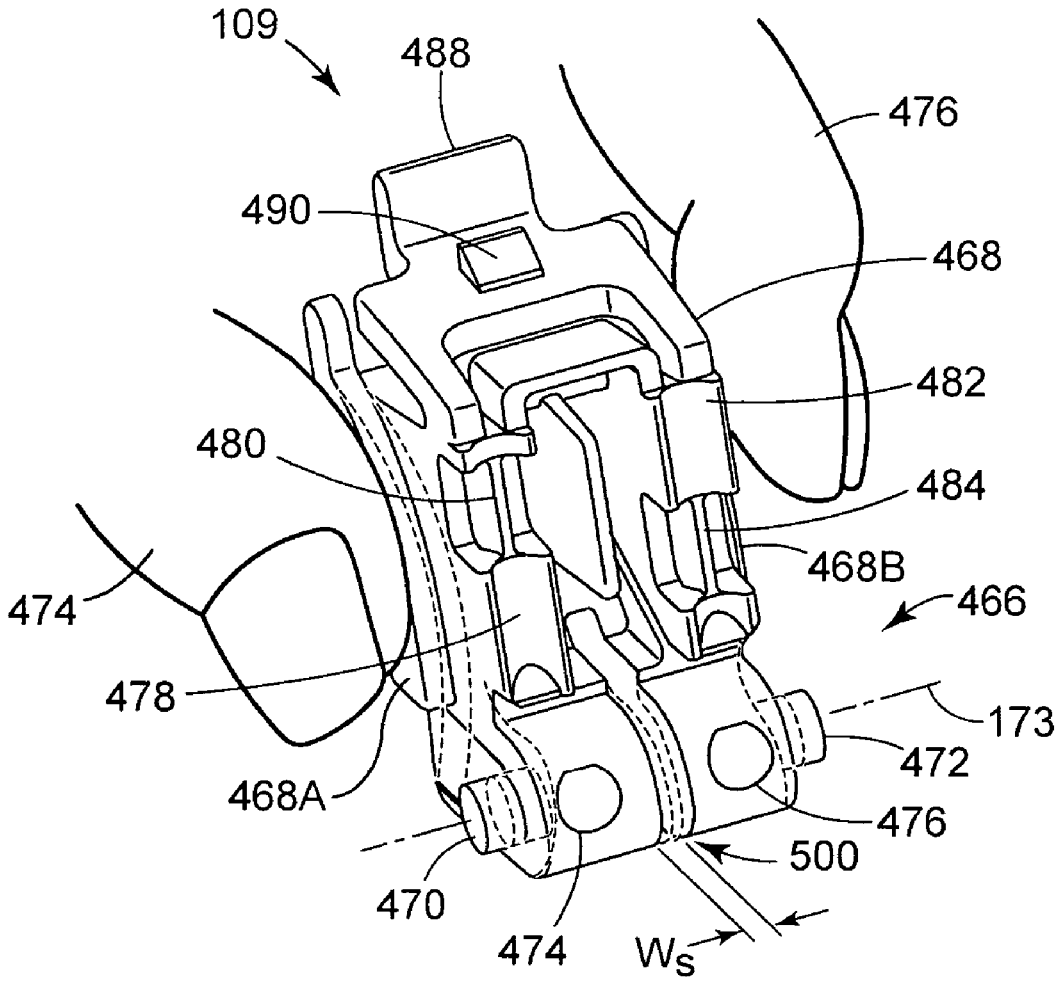
FIG. 3D is a perspective view of the underside of a third alternate embodiment of a cap.

In each of the alternate embodiments of a cap discussed in reference to FIGS. 3B-3D, the caps 107 (FIG. 3B), 108 (FIG. 3C), and 109 (FIG. 3D) have certain portions that may be manipulated in order to move a first pivot projection and/or a second coaxial pivot projection. This allows the caps 107, 108 and 109 to fit within the gap 124 (shown in FIG. 1) created between adjacent lock projections 122 (shown in FIG. 1) after the connector unit 104 is attached to the base unit 102. The caps 107, 108, and 109 are both attachable and removable after the connector unit 104 is attached to the base unit 102.

FIG. 3B is a perspective view of a first alternate embodiment of a cap 107, which may be incorporated into the connector assembly 100 of FIG. 1. The cap 107 may be connected to the connector unit 104 after the connector unit 104 is attached to the base unit 102. This aids in the replacement of one or more caps 107 after the connector assembly 100 is assembled. The cap 107 is similar in structure to the cap 106 of FIG. 3A. However, the cap 107 differs from the cap 106 because the cap 107 includes a means for allowing a first pivot projection 270 and a second coaxial pivot projection 272 to move inward in order to reduce a greatest width $W_C$ of the cap 107 to less than or equal to the width $W_G$ of the gap 124. At the reduced width, the cap 107 fits within the gap 124 created between adjacent lock projections 122 (shown in FIG. 1).

In the first alternate embodiment, the cap 107 includes springs 274 and 276, which are housed in sockets 278 and 280, respectively, formed in the cap 107. The spring 274 (shown in phantom) biases the first pivot projection 270 away from the pivot portion 266 of the cap 107 and the spring 276 (shown in phantom) biases the second coaxial pivot projection 272 away from the pivot portion 266 of the cap 107. A user may compress the spring 274 to retract the first pivot projection 270 into the socket 278 (shown in phantom) and compress the spring 276 to retract the second pivot projection 272 into the socket 280 (shown in phantom), respectively. Thereafter, the user may position the cap 107 within the gap 124 (shown in FIG. 1).

After the cap 107 is positioned within the gap 124, the springs 274 and 276 encourage the first pivot projection 270 and the second pivot projection 272, respectively, to move into the hinge slots 148 and 150 (shown in FIG. 2), respectively, and engage therewith. The first and second pivot projections 270 and 272 are then connected to the connector unit 104 and are free to rotate about the axis 173 within the hinge slots 148 and 150, respectively. In this way, the cap 107 is pivotally mounted to the connector unit 104.

After the cap 107 is attached to the connector unit 104, the cap 107 is removable therefrom by compressing the springs 274 and 276 to retract the first pivot projection 270 and the second pivot projection 272, respectively, from the sockets 278 and 280, respectively. This disengages the first pivot projection 270 and the second pivot projection 272 from the hinge slots 148 and 150, respectively, allowing a user to remove the cap 107 from the connector unit 104 and replace the cap 109 if so desired.

Alternatively, only one side of the pivot portion 266 of the cap 107 includes a socket configured to receive a pivot projection 270 or 272, and only one of the pivot projections 270 or 272 retracts. In some configurations of the connector unit 104, a retraction of only one pivot projection 270 or 272 will still enable the width $W_C$ of the cap 107 to be adjusted sufficiently to allow the cap 107 to fit within the gap 124.

FIG. 3C is a perspective view of a second alternate embodiment of the cap 108, which may be incorporated into connector assembly 100 of FIG. 1. Just as with the cap 107 shown in FIG. 3B, the cap 108 may be connected to the connector unit 104 after the connector unit 104 is attached to the base unit 102. In the second alternate embodiment, the cap 108 is similar in structure to the cap 106 of FIG. 3A. The cap 108 differs from the cap 106 because the cap 108 includes a first pivot projection 370 and a second coaxial pivot projection 372, which are formed of a material that permits each of the projections 370 and 372 to be flexible enough to flex both away from (i.e., a first position) and toward (i.e., a second position) the pivot portion 366 of the cap 108. In FIG. 3C, the first pivot portion 370 is shown to be in a first position 370A, with a second position 370B of the first pivot portion 370 shown in phantom. Similarly, the second pivot portion 372 is shown to be in a first position 372A, with a second position 372B of the second pivot portion 372 shown in phantom. Each pivot projection 370 and 372 is inclined to stay in its respective first position, and in this way, each pivot projection 370 and 372 is biased away from the pivot portion 366 of the cap 108.

Flexing the projections 370 and 372 into their respective second positions (e.g., the second position 372B of the second pivot portion 372) provides sufficient clearance for the cap 108 to fit within the gap 124 (shown in FIG. 1). That is, flexing the projections 370 and 372 decreases the greatest width $W_C$ of the cap 108 such that it is less than or equal to the width $W_G$ of the gap 124. After the cap 108 is positioned within the gap 124, the first and second coaxial pivot projections 370 and 372 flex toward and into the hinge slots, 148 and 150 (shown in FIG. 2), respectively. Because the pivot projections 370 and 372 are biased away from the cap 108, the pivot projections 370 and 372 are inclined to move away from the cap 108 into their respective first positions (e.g., the first position 372A of the second pivot portion 372) and into the hinge slots 148 and 150, respectively. The cap 108 is then pivotally mounted to the connector unit 104 because the first and second pivot projections 370 and 372 are free to rotate about the axis 173 within the hinge slots 148 and 150, respectively.

After the cap 108 is attached to the connector unit 104, the cap 108 is removable therefrom by pulling the cap 108 out of the gap 124 with a force sufficient enough to flex the first pivot projection 370 and the second pivot projection 372 toward the pivot portion 366 and into their respective second positions 370B and 372B. This disengages the first pivot projection 370 and the second pivot projection 372 from the hinge slots 148 and 150, respectively, allowing a user to remove the cap 108 from the connector unit 104 and replace the cap 108 if so desired. Other suitable means for flexing the first and second pivot projections 372 toward the pivot portion 366 may also be used.

Alternatively, the cap 108 is configured such that only one of the pivot projections 370 or 372 is flexible. In some configurations of the connector unit 104, this still enables the width $W_C$ of the cap 108 to be adjusted sufficiently to allow the cap 108 to fit within the gap 124.

FIG. 3D is a perspective view of a third alternate embodiment of the cap 109, which includes a pivot portion 466 and a cover portion 468. The pivot portion 466 includes recesses 474 and 476. Just as with the caps 107 (FIG. 3B) and 108 (FIG. 3C), the cap 109 may be connected to the connector unit 104 after the connector unit 104 is attached to the base unit 102, and the cap 109 is similar in structure to the cap 106 of FIG. 3A. For example, the cap 109 includes a resilient latch 488 with a projection 490, which are similar to the resilient latch 188 and projection 190 of the cap 106. The cap 109 also includes wire huggers 478 and 482 and wire stuffers 480 and 484, which are similar to wire huggers 178 and 182 and wire stuffers 180 and 184 of the cap 106 of FIG. 3A. The cap 109, however, differs from the cap 106 because the pivot portion 466 and the cover portion 468 of the cap 109 are formed of a material that deforms upon the application of force, but returns to its original shape (i.e., the shape of the cap 106 shown in FIG. 3A) after the force is removed. Examples of suitable materials that exhibit this property include filled and unfilled acetals, acrylics, acetates, cellulose derivatives, fluoropolymers, liquid crystal polymers, polyamides, polyimides, polyarylsulfones, polybenzimidazoles, polycarbonates, polyolefins, polyesters, polyethers, polyketones, polyetheretherketones, polyetherimides, polyethersulfones, polyphenylether, polyphenylsulfone, polyurethane, phenolics, silicones, and rubbers.

In some embodiments of the cap 109, the pivot portion 466 and the cover portion 468 are an integral unit, while in other embodiments, the pivot portion 466 and the cover portion 468 are separate pieces that are attached using a suitable means (e.g., adhesive, mechanically mating flanges, or the like) to form a single unit. Because the pivot portion 466 and the cover portion 468 are either an integral unit or are attached, movement of the cover portion 468 causes the pivot portion 466 to move. For example, the application of force on the sides 468A and 468B of the cover portion 468 to deform the shape of the cover portion 468 also causes the pivot portion 466 to deform.

A user may squeeze or otherwise compress the sides 468A and 468B of cover portion 468 inward (i.e., toward a center of the cover portion 468) in order to move the pivot portion 466 inward. FIG. 3D shows the user's fingers 474 and 476 compressing the sides 468A and 468B of the cover portion 468. Of course, a tool may also be used to apply the force. As the sides 468A and 468B move inward, the pivot portion 466 also moves inward because it is attached to or integral with the cover portion 468 (as shown in phantom lines). The pivot portion 466 includes a slit 500, which provides room for the pivot portion 466 to move inward. Although the embodiment of the cap 109 shown in FIG. 3D shows the slit 500 being centered with respect to the pivot portion 466, the slit 500 may be uncentered in alternate embodiments. As the pivot portion 466 moves inward, the first and second pivot projections 470 and 474, which are attached to the pivot portion 466, move inward as well (as shown in phantom lines). The inward movement of the cover portion 468, pivot portion 466, and pivot projections 470 and 472 reduces the greatest width $W_C$ of the cap 109 to less than or equal to the width $W_G$ of the gap 124 and enables the user to fit the cap 109 within the gap 124 (shown in FIG. 1).

A width $W_S$ of the slit 500 in the pivot portion 466 of the cap 109 is determined by the distance the pivot projections 470 and 472 need to move in order to adjust the greatest width $W_C$ of the cap 109 to be less than or equal to the width $W_G$ of the gap 124. Of course, the width $W_S$ of the slit 500 should not be great enough to compromise the integrity of the cap 109. In some embodiments, the pivot portion 466 of the cap 109 may become flimsy if the slit 500 accounts for a certain percentage of the pivot portion 466. The percentage depends upon many factors, including the type of material that is used to form the pivot portion 466. The embodiments of the cap 109, therefore, have a slit 500 with a width $W_S$ that does not compromise the integrity of the cap 109.

After the user positions the cap 109 within the gap 124, the user may release the side portions 468A and 468B. The cap 109 then returns to its original shape (or substantially the original shape) and the pivot projections 470 and 472 move into the hinge slots 148 and 150 (shown in FIG. 2), respectively. When engaged with the hinge slots 148 and 150, the pivot projections 470 and 472, respectively, are rotatable about the axis 173 within the hinge slots 148 and 150. In this way, the cap 109 pivotally mounts to the connector unit 104.

After the cap 109 is attached to the connector unit 104, a user may remove the cap 109 therefrom by compressing the sides 468A and 468B of the cover portion 468. As previously stated, this also causes the pivot portion 466 and pivot projections 470 and 472 to move inward. After the pivot projections 470 and 472 are moved inward a sufficient amount to reduce the width $W_C$ to less than or equal to the width $W_G$ of the gap 124, the first pivot projection 470 and the second pivot projection 472 are disengaged from the hinge slots 148 and 150, respectively. The user may then remove the cap 109 from the connector unit 104 and replace the cap 109 if so desired.

Alternatively, the cap 109 is configured such that only one side of the cover portion 468 and pivot portion 466 is deformable. In some configurations of the connector unit 104, this still enables the width WC of the cap 109 to be adjusted sufficiently to allow the cap 109 to fit within the gap 124.

FIG. 4 is a perspective view of the connector unit 104 showing a housing 130 with the cap 109 attached in an open position. In alternate embodiments, the caps 106, 107, or 108 are suitably substituted for cap 109. Furthermore, a description of certain aspects of the cap 109 that are similar to features of the caps 106, 107, and 109 is representative of the like features of the caps 106, 107, and 109. For example, each of the caps 106, 107, 108, and 109 includes a pair of wire stuffers, wire huggers, recesses in the pivot portion, and latching mechanisms. Again, the electrical conductors have been omitted in FIG. 4 to show the internal configuration and components of the housing 130. However, first electrical conductor 200 and second electrical conductor 206 can be seen extending from the adjacent housing.

The first IDC element 300 and a first blade 162 are located at the base 134 of the first section 135 of the housing 130. The first blade 162 is located adjacent to the pivot portion 466 of the cap 109. A first support 163 with a generally U-shape to support and cradle an electrical conductor when inserted into the housing 130 is positioned in front of the first blade 162. When the cap 109 is closed and pressing down on the electrical conductor, the first support 163 supports the electrical conductor so that the first blade 162 can properly and effectively cut the electrical conductor. Then, the first blade 162 enters the first indent 462*a* on the cap 109.

The second IDC element 301 and a second blade 164 are located at the base 134 of the second section 137 of the housing 130. The second blade 164 is located adjacent to the pivot portion 466 of the cap 109. A second support 165 with a generally U-shape to support and cradle an electrical conductor when inserted into the housing 130 is positioned in front of the second blade 164. When the cap 109 is closed and pressing down on the electrical conductor, the second support 165 supports the electrical conductor so that the second blade 164 can properly and effectively cut the electrical conductor. Then, the second blade 164 enters the second indent 464*a* on the cap 109.

Figure 5:
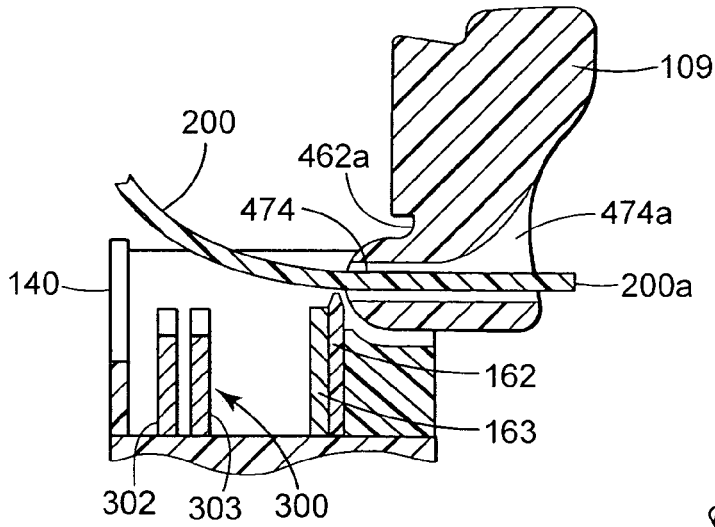
FIG. 5 is a schematic sectional view through the connector unit of FIG. 4, with an electrical conductor inserted through a recess in the cap and the cap in a fully opened position relative to the housing.
Figure 7:
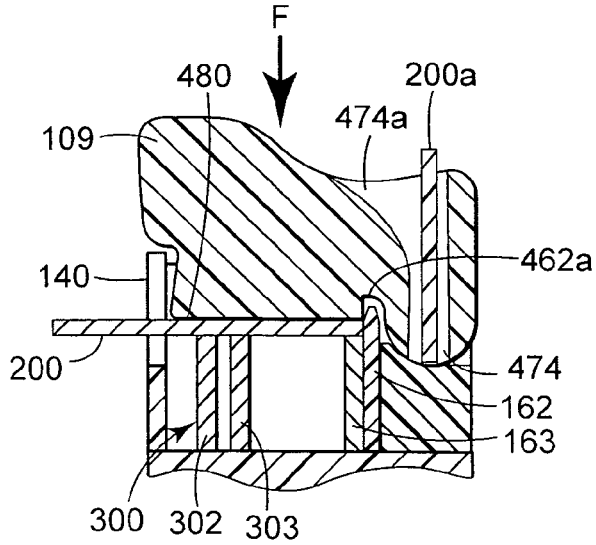
FIG. 7 is a schematic sectional view through the connector unit of FIG. 4, with the electrical conductor inserted through the recess being cut and the cap in a fully closed position relative to the housing.

The first blade 162 and second blade 164 may be constructed of a metallic material and have a slightly sharpened edged, as is more clearly shown in FIGS. 5-7. For example, the blades may be constructed of stainless steel alloy S30100, full hard temper, per ASTM A666-03. In addition, the blades 162, 164 may be constructed of a component extending from the base 134 of the housing 130, and therefore be non-metallic. In such a case, the blades 162, 164 may also have a slightly sharpened edge, which creates a pinch point to cut the electrical conductors when the cap 109 is moved to a closed position.

It is preferable to insert a single electrical conductor into each section 135, 137 of the housing 130 and into the recesses 474, 476, respectively, in the pivot portion 466 of the cap 109 to be cut by the blades 162, 164, respectively. However, in some instances two electrical conductors may be inserted into each section 135, 137 of the housing 130 and into the recesses 474, 476, respectively, to be cut by the blades 162, 164, respectively. Further, the first blade 162 and second blade 164 shown in FIG. 4 are symmetrically arranged within the housing 130. However, the first and second blades 162, 164 may be staggered (radially displaced relative to the pivot axis 173) or may have different heights relative to the base 134 of the housing 130. By either staggering the blades 162, 164 or varying the heights of the blades 162, 164, it is possible to vary the sequencing of cutting the electrical conductors, thereby minimizing the force needed to close the cap 109 and cut the electrical conductors.

FIG. 4 shows the linear arrangement of the first IDC element 300 on the first section 135 of the housing 130 and the second IDC element 301 on the second section 137 of the housing 130. As can be seen, the first wire groove 140, first IDC element 300, first support 163, first blade 162, and first recess 474 in the cap 109 are generally linearly arranged along a first plane 136 within the first section 135 of the housing 130. Within the second section 137 of the housing 130, the second wire groove 142, second IDC element 301, second support 165, second blade 164, and second recess 476 in the cap 109 are generally linearly arranged along a second plane 138. Relative to the pivot axis 173 of the cap 109, the first IDC element 300 and the second IDC element 301 are off-set (i.e., radially staggered) from one another along their respective planes, 136, 138. As shown, the second IDC element 301 is closer to the pivot portion 166 of the cap 109 than the first IDC element 300. This staggering of the first IDC element 300 and second IDC element 301 minimizes the force needed to be applied to the cap 109 to properly close the cap 109 and engage all electrical conductors in each IDC element, because the electrical conductors are not being forced into their respective IDC elements at the same time during closure. Instead, the electrical conductor for the IDC element closest to the pivot portion 466 of the cap 109 (second IDC element 301) is pressed into engagement first, and the electrical conductor at the IDC element farthest from the pivot portion 466 of the cap 109 (first IDC element 300) is pressed into engagement last. Further, the cutting of the electrical conductors during cap 109 closure (at each blade 162, 164) can occur during insertion but prior to final insertion is reached or can occur before the electrical conductors are inserted into their respective IDC elements 301, 300, which further minimizes the forces needed to close the cap 109 while making the proper connections.

Although the first IDC element 300 and the second IDC element 301 are shown staggered relative to the pivot axis 173, the first IDC element 300 and second IDC element 301 may be uniformly arranged within the housing 130. Further, the first IDC element 300 and the second IDC element 301 may have different heights relative to the base 134 of the housing 130 such that electrical conductors will first be inserted into the higher IDC element, and then into the lower IDC element. As mentioned above, the blades 162, 164 may also be staggered or have varying heights and the wire stuffers 480, 484 may also have different lengths. Sequencing the insertion of the electrical conductors into the IDC elements, along with sequencing the cutting of the electrical conductor, minimizes the forces needed to close the cap 109 while making the proper connections.

Although the housing 130 as shown and described has a first section 135 and a second section 137 with essentially similar components on each section, the housing 130 may include a single set of components like the wire groove, recess in the pivot portion, IDC element, blade, support, etc.

In use, an electrical conductor, which includes a conductive core surrounded by an insulation layer, is inserted into the first section 135 of the housing 130 and into the first recess 474. A similar electrical conductor can likewise be inserted into the second section 137 and into the second recess 476. Although it is preferable to insert the electrical conductor into each section of the housing one at a time, two electrical conductors may be inserted into each section of the housing 130. Once in place, the cap 109 is closed to insert the electrical conductors into the slots of the IDC element and the blade cuts the portion of the electrical conductor passing into the recesses.

Electrical conductors are typically coupled to the connector assemblies 100 in the field. Accordingly, ease of use and achieving a high probability of effective electrical coupling of the components is important. The conditions of use and installation may be harsh, such as outdoors (i.e., unpredictable weather conditions), underground cabinets (i.e., tight working quarters), and non-highly skilled labor. Thus, the simpler the process of connecting an electrical conductor to the IDC element in the connector assembly, the better. The present invention achieves this end by providing an arrangement for aligning an electrical conductor for connection with an IDC element, and for providing an operator with affirmative feedback that the alignment was correct (and thus a proper electrical coupling has been made) even after the cap has been closed and the alignment of components is no longer visible. FIGS. 5, 6, and 7 illustrate the effective alignment and electrical coupling arrangement of the present invention.

As illustrated in FIGS. 5, 6, and 7, the first IDC element 300 has a first contact 302 and a second contact 303. The first contact 302 has a first insulation displacement slot 311 therein and the second contact 303 has a second insulation displacement slot 321 therein, with those insulation displacement slots configured to receive, in an electrically conductive manner, an electrical conductor (see FIGS. 8, 9, and 10 for further description of the first and second contacts 302, 303 of the first IDC element 300).

FIG. 5 is a schematic sectional view through the first section 135 of one of the housings 130, as taken along plane 136 (FIG. 4). The cap 109 is in an open position, and an electrical conductor 200 passes through the first recess 474 in the cap 109. A distal end 200*a* of the electrical conductor 200 is inserted into the first section 135 of the housing 130 and into the first recess 474. The electrical conductor 200 is aligned over the first IDC element 300 and first wire groove 140.

FIG. 6 is a schematic sectional view through the first section 135 of one of the housings 130, as taken along plane 136 (FIG. 4) with the electrical conductor 200 through the first recess 474 in the cap 109 and the cap 109 in the process of being closed, by application of force F on its upper surface. Proximally from the distal end 200*a*, the electrical conductor 200 passes through the first wire groove 140 (see FIGS. 4 and 6). To make the electrical connection between the electrical conductor 200 and first IDC element 300, a user begins to close the cap 109 by application of force F. As can be seen, the surface of the cap 109 is curved so as to allow a user's finger or thumb to easily engage and ergonomically close the cap 109.

The first wire stuffer 480 and first wire hugger 478 approach an upper exposed surface of the electrical conductor 200 and begin to make contact therewith. The electrical conductor 200 is thus urged into contact with first support 163, which is adjacent to the first blade 162.

FIG. 7 is a schematic sectional view through the first section 135 of one of the housings 130, as taken along plane 136 (FIG. 4) with an electrical conductor cut and the cap 109 in a closed position. The electrical conductor 200 includes a conductive core 204 surrounded by an insulation sheath layer 202 (see FIG. 9 and 10). When the electrical conductor 200 begins to make contact with the first IDC element 300, the electrical conductor 200 enters the second insulation displacement slot 321 and then enters the first insulation displacement slot 311 within the first IDC element 300. The insulation displacement slots 321, 311 have at least one part that is narrower than the overall electrical conductor 200 such that the insulation sheath layer 202 is displaced and the conductive core 204 makes electrical contact with the conductive IDC element.

When the cap 109 entirely closes, the resilient latch 488 flexes so that the latch projection 490 can engage with the latch opening 146 on the front wall 131 of the housing to lock the cap 109 in it closed position (see FIG. 4). The electrical conductor 200 extends proximally out of the housing 130 at the first wire groove 140 (see FIG. 4). When the cap 109 is closed, the first wire stuffer 480 has entirely pressed and followed the electrical conductor 200 into the first insulation displacement slot 311 of the first contact 302 and the second insulation displacement slot 321 of the second contact 303 (see FIG. 8). The electrical conductor 200 has rested on the first support 163 and the pressure of the cap 109 on the electrical conductor 200 at the first blade 162 has severed the electrical conductor 200. The electrical conductor 200 remaining includes a proximal connected portion 201 electrically connected to the first IDC element 300 and a distal unconnected portion 203, which had extended through the first recess 474. Electrical conductor 200 has been severed adjacent the first recess 474, and the distal unconnected portion 203 is no longer electrically connected to the first IDC element 300. Thus, no portion of the electrical conductor 200, which extends through the cap 109 is in electrical contact with the first IDC element 300. In this embodiment, the first recess 474 passes entirely through the cap 109 and so the distal unconnected portion 203 of the electrical conductor 200 may be discarded.

The first and second recesses 474, 476 on the underside of the cap 109 may be generally circular (see FIG. 3A). However, as can be seen in FIG. 1, 2, 4, and 5-7, ends 474*a* and 476*a* of the first and second recesses 474, 476 visible on a top surface of the cap 109 have an oval shape. The oval shape allows a user better access to the distal unconnected portion 203 of electrical conductor 200 passing through the recesses 474, 476, and thus makes it easier to discard this waste. It is preferable that the recesses 474, 476 are through holes as shown in FIG. 7 so that the unconnected portion can be removed. However, the recesses 474, 476 may be openings in the pivot portion 466 of the cap 109 such that the cut portion of the electrical conductor remains in the recesses 474, 476 when the cap 109 is closed.

When the cap 109 is closed, the cap 109 may entirely seal the housing 130. Additionally, a gel or other sealant material may be added to the housing 130 prior to the closure of the cap 109 to create a moisture seal within the housing 130 when the cap 109 is closed. Sealant materials useful in this invention include greases and gels, such as, but not limited to RTV® 6186 mixed in an A to B ratio of 1.00 to 0.95, available from GE Silicones of Waterford, N.Y.

Gels, which can be described as sealing material containing a three-dimensional network, have finite elongation properties that allow them to maintain contact with the elements and volumes they are intended to protect. Gels, which are useful in this invention, may include formulations which contain one or more of the following: (1) plasticized thermoplastic elastomers such as oil-swollen Kraton triblock polymers; (2) crosslinked silicones including silicone oil-diluted polymers formed by crosslinking reactions such as vinyl silanes, and possibly other modified siloxane polymers such as silanes, or nitrogen, halogen, or sulfur derivatives; (3) oil-swollen crosslinked polyurethanes or ureas, typically made from isocyanates and alcohols or amines; (4) oil swollen polyesters, typically made from acid anhydrides and alcohols. Other gels are also possible. Other ingredients such as stabilizers, antioxidants, UV absorbers, colorants, etc. can be added to provide additional functionality if desired.

Useful gels will have ball penetrometer readings of between 15 g and 40 g when taken with a 0.25 inch diameter steel ball and a speed of 2 mm/sec to a depth of 4 mm in a sample contained in a cup such as described in ASTM D217 (3 in diameter and 2.5 in tall cylinder filled to top). Further, they will have an elongation as measured by ASTM D412 and D638 of at least 150%, and more preferred at least 350%. Also, these materials will have a cohesive strength, which exceeds the adhesive strength of an exposed surface of the gel to itself or a similar gel.

Representative formulations include gels made from 3-15 parts Kraton G1652 and 90 parts petroleum oil, optionally with antioxidants to slow decomposition during compounding and dispensing.

When the cap 109 is closed, the user cannot visually see if the electrical conductor 200 is properly in place within the first IDC element 300. However, the user is able to verify that the proximal portion of the electrical conductor 200 is properly extending through the first wire groove 140 and that the distal end 200*a* of the electrical conductor 200 has been cut by the blade 162. With the ability to verify that each end of the electrical conductor 200 has been properly placed, the user can interpolate that the middle of the electrical conductor 200 has been properly aligned and inserted into the IDC element.

The positioning and additionally the height from the base 134 of the housing 130 of the first IDC element 300, second IDC element 301, first blade 162, and second blade 164 all assist in reducing the forces necessary for making the electrical connection between the electrical conductors 200, 206 and the IDC elements 300, 301. The positioning and length of the first wire stuffer 180 and second wire stuffer 184 may also be manipulated to assist in reducing the forces necessary for closing the cap 109 and making the electrical connections. The present invention effectively allows for a distribution of the forces necessary for cutting the electrical conductor and electrically coupling the electrical conductor to the IDC element through the use of a pivoting cap, without the use of special closure tools by effectively sequencing the cutting of the electrical conductors and insertion of the electrical conductor into the contacts.

When an electrical conductor is positioned on both the first section 135 and the second section 137 of the housing 130, the electrical conductors are first cut at the blade either simultaneously or sequentially, depending on the arrangement of the blade. Then, as the cap continues to close, the wire stuffers sequentially stuff the electrical conductors into the first and second contacts of the second IDC element 301 and then into the first and second contacts of the first IDC element 300, when arranged as shown in FIG. 4. Because of the arced shape of the closing cap and the staggering of the IDC elements, the stuffing of the wires into the IDC elements does not occur all at once but sequentially, further reducing the closure force. After the electrical conductors are in place, the cap is snapped shut. Because the cutting, stuffing, and closing of the cap are all separated and do not occur at the same time, the force required by the user is reduced. Varying the height of the IDC elements with respect to one another or varying the lengths of the wire stuffers with respect to one another will also result in a sequential insertion of the electrical conductor in the contacts.

Although only a single electrical conductor 200 is described as entering the first section 135 of the housing 130, a second electrical conductor 206 (FIG. 4) may be inserted on top of the electrical conductor 200. It is preferable that the first electrical conductor 200 be entirely inserted first and then the cap 109 opened to receive the second electrical conductor 206. The second electrical conductor 206 would be inserted just as the first electrical conductor 200 was inserted as described above and shown in FIGS. 5-7. There may be instances where both electrical conductors may be inserted at once. The insertion of the electrical conductor 200 has been discussed with respect to only the first section 135 of the housing. However, it is understood that at the second section 137 of the housing 130 a single or even two electrical conductors may be inserted in a similar manner. Further description of the insertion of two electrical conductors is described in U.S. patent application Ser. No. 10/941,506, entitled "INSULATION DISPLACEMENT SYSTEM FOR TWO ELECTRICAL CONDUCTORS" filed on Sep. 15, 2004, the disclosure of which is hereby incorporated by reference.

Figure 8:
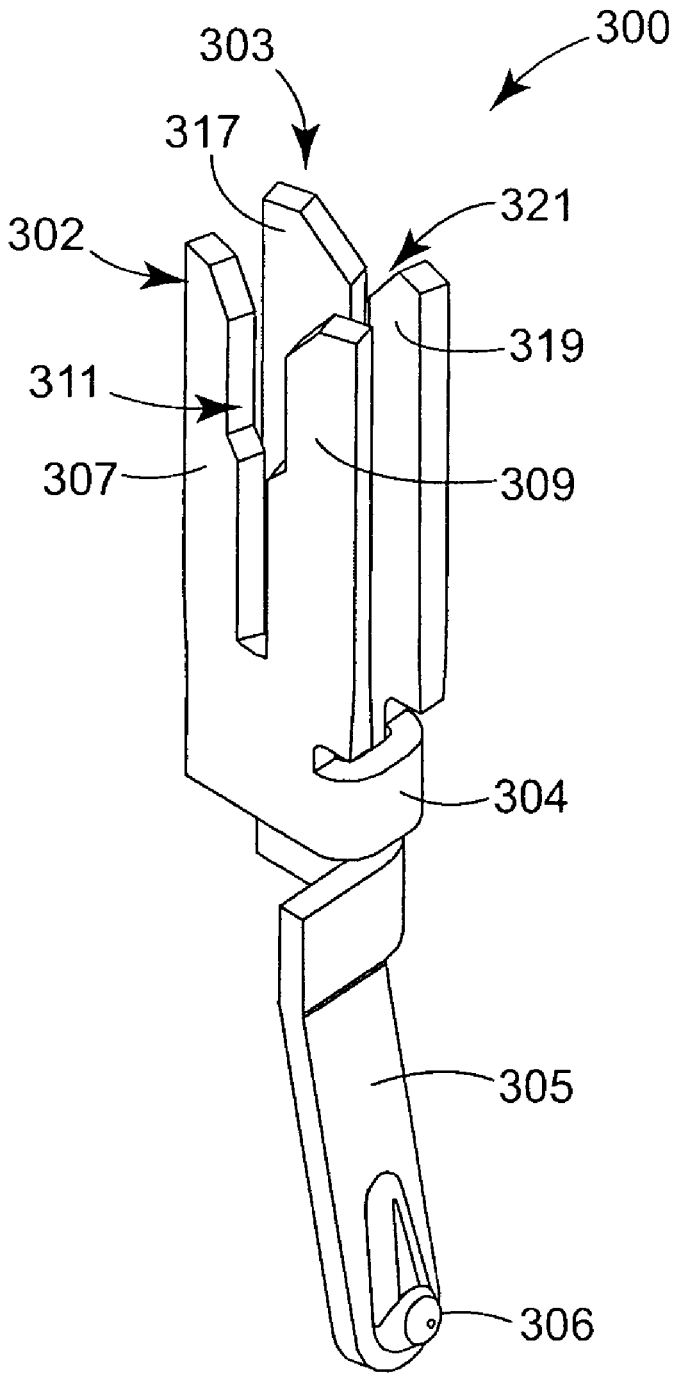
FIG. 8 is a perspective view of an insulation displacement element of the present invention.

FIG. 8 is a perspective view of the first IDC element 300. The first IDC element 300 includes the first contact 302 and the second contact 303, which are electrically connected to one another by a bridging section 304.

Extending below and biased from the bridging section 304 is a resilient tail 305. A raised tab 306 projecting from the tail 305 helps make an electrical connection to another element. When the first IDC element 300 is placed in the first section 135 of the housing 130, the tail 305 extends in a direction towards the test probe slot 152 (see FIGS. 11 and 12).

Figure 9:
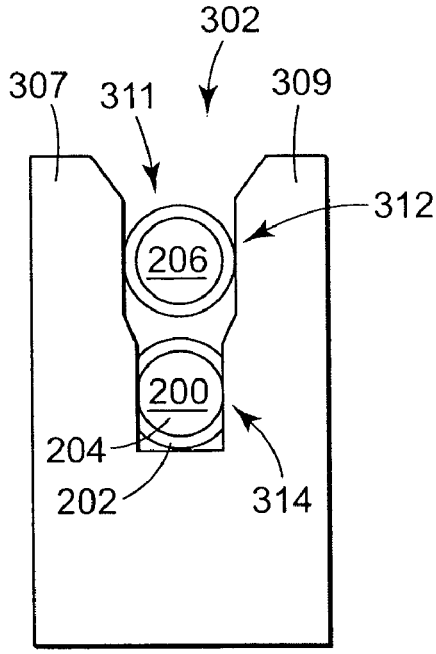
FIG. 9 is a front view of a U-shaped portion of a first contact of the insulation displacement element of the present invention.

As seen in FIG. 8 and FIG. 9, which is a front view of a portion of the first contact 302, the first contact 302 has a generally U-shape, including a first leg 307 and a second leg 309 spaced from one another to form a first insulation displacement slot 311. The first insulation displacement slot 311 has a wide portion 312 and a narrow portion 314. At the wide portion 312 the first leg 307 and the second leg 309 are spaced farther from one another than at the narrow portion 314. For the first contact 302, the wide portion 312 is located adjacent the open end of the first insulation displacement slot 311, while the narrow portion 314 is located intermediate the wide portion 312 and the closed end of the first insulation displacement slot 311.

Figure 10:
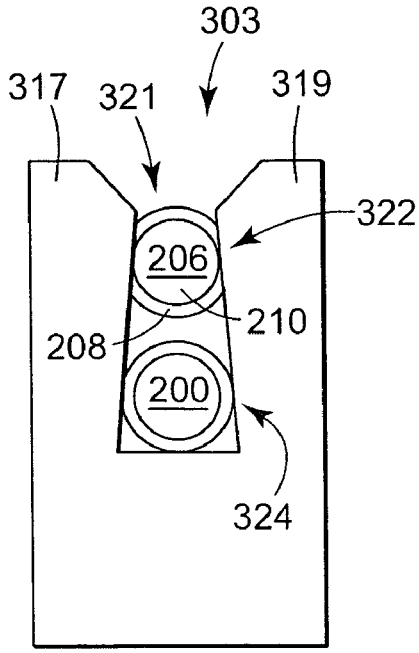
FIG. 10 is a front view of a U-shaped portion of a second contact of the insulation displacement element of the present invention.

As seen in FIG. 8 and 10, which is a front view of a portion of the second contact 303, the second contact 303 also has a generally U-shape similar to the first contact 302, including a first leg 317 and a second leg 319 spaced from one another to form a second insulation displacement slot 321. The second insulation displacement slot 321 has a wide portion 324 and a narrow portion 322. However, the wide portion 324 of the second insulation displacement slot 321 is opposite to the wide portion 312 of the first insulation displacement slot 311. At the wide portion 324 the first leg 317 and the second leg 319 are spaced farther from one another than at the narrow portion 322. For the second contact 303, the narrow portion 322 is located adjacent the open end of the second insulation displacement slot 321, while the wide portion 324 is located intermediate the narrow portion 322 and the closed end of the second insulation displacement slot 321.

At the narrow portion 314 of the first contact 302, the first leg 307 and second leg 309 displace the insulation sheath 202 covering the first electrical conductor 200 so that the conductive core 204 makes electrical contact with the legs 307, 309. At the narrow portion 322 of the second contact 303, the first leg 317 and second leg 319 displace the insulation sheath 208 covering the second electrical conductor 206 so that the conductive core 210 makes electrical contact with the legs 317, 319. Therefore, the first and second electrical conductors 200, 206 are electrically connected to the first IDC element 300, and are electrically connected to one another.

Although not shown independently as in FIG. 8, the second IDC element 301 is similar to the first IDC element 300. However, its tail extends in the opposite direction. The tail of the second IDC element 301 extends towards the center to the test probe slot 152. The second IDC element 301 may also be configured with first and second contacts having wide portions and narrow portions. The wide portion and narrow portions may be configured in reverse order, relative to the first IDC element 300 (as considered from a radial perspective relative to the pivot axis 173).

Although the IDC element is shown having a first contact 302 and a second contact 303, it is understood that the IDC element may be an IDC element with just one contact. Also, the IDC element of the present invention may or may not have the wide portion and narrow portion described with respect to the IDC element shown in the Figures and in particular in FIG. 8. Further description of various insulation displacement connector elements and combinations thereof for use with the housing of the present invention is described in U.S. patent application Ser. No. 10/941,506, entitled "INSULATION DISPLACEMENT SYSTEM FOR TWO ELECTRICAL CONDUCTORS" filed on Sep. 15, 2004, the disclosure of which is hereby incorporated by reference.

Any standard telephone jumper wire with PCV insulation may be used as the electrical conductor. The wires may be, but are not limited to: 22 AWG (round tinned copper wire nominal diameter 0.025 inches (0.65 mm) with nominal PVC insulation thickness of 0.0093 inches (0.023 mm)); 24 AWG (rounded tinned copper wire nominal diameter 0.020 inches (0.5 mm) with nominal PVC insulation thickness of 0.010 inches (0.025 mm); 26 AWG (rounded tinned copper wire nominal diameter 0.016 inches (0.4 mm) with nominal PVC insulation thickness of 0.010 inches (0.025 mm).

FIG. 11 is a perspective view through the connector unit 104 (shown in phantom) showing the connection between the first IDC element 300 and an electrical element 114. The first IDC element 300 is positioned in the connector unit 104 with the tail 305 extending into the base unit 102 (not shown). The electrical element 114 is an IDC element, which makes electrical connection with cables that may be connected to the office or the subscriber. The electrical element 114 has a tail 114*a* that resiliently and electrically contacts the tail 305 of the first IDC element 300.

FIG. 12 is a perspective view through the connector unit 104 (shown in phantom) showing a test probe 350 inserted between the connection of the first IDC element 300 and the electrical element 114. The test probe 350 is first inserted through the test probe slot 152 (see FIG. 2 and FIG. 4). The test probe 350 is capable of breaking the contact between the first IDC element 300 tail 305 and the tail 114*a* of the electrical element 114. Breaking this connection and using a test probe, as is known in the art, allows the tester to electrically isolate a circuit on both sides of the test probe 305 at the IDC tail connection and thus to test both ways for problems.

Although FIGS. 11 and 12 show the electrical connection between the first IDC element 300 and electrical element 114, it is understood that the second IDC element 301 would also make a connection to another electrical element (similar to the element 114 shown and described). However, the second IDC element 301 is positioned on the second section 137 of the housing and therefore on the opposite side of the test probe slot 152. The test probe 350 is capable of entering the test probe slot 152 and breaking the resilient connection between the tail of the second IDC element 301 and the tail of the other electrical element (the tail orientations would be similar to that described above, but in reverse).

Although the present invention has been described with reference to preferred embodiments, workers skilled in the art will recognize that changes may be made in form and detail without departing from the spirit and scope of the invention.

What is claimed is:

1. A cap configured to connect to an insulation displacement connector (IDC) block, the cap having an adjustable width and comprising:

a body including a pivot portion and a cover portion; and a first pivot projection attached to the body at the pivot portion and configured to engage with a first aperture in the IDC block, wherein at least one of the body and the first pivot projection is manipulable in order to adjust the width of the cap, wherein the first pivot projection is formed of a flexible material and disposed in a first position and wherein the first pivot projection is adapted to flex toward the body to a second position to decrease the width of the cap.

2. The cap of claim 1 wherein the first pivot projection extends from the pivot portion of the body.

3. The cap of claim 1 wherein the cap is capable of pivoting between an open position and a closed position when the first pivot projection is engaged with the first aperture in the IDC block.

4. The cap of claim 1 wherein the first pivot projection is biased away from the body.

5. The cap of claim 1 wherein the cover portion and pivot portion are an integral unit.

6. The cap of claim 5 wherein the pivot portion of the body includes a slit.

7. The cap of claim 1 wherein the body is at least partially formed of a material selected from a group consisting of a polyether imide resin; a polybutylene terephthalate (PBT) resin flame retardant, 30% glass fiber reinforced material; a polyarylamide resin, flame retardant, 30% glass fiber reinforced material; and a polyarylamide resin, flame retardant, 50% glass fiber reinforced material, filled and unfilled acetals, acrylics, acetates, cellulose derivatives, fluoropolymers, liquid crystal polymers, polyamides, polyimides, polyarylsulfones, polybenzimidazoles, polycarbonates, polyolefins, polyesters, polyethers, polyketones, polyetheretherketones, polyetherimides, polyethersulfones, polyphenylether, polyphenylsulfone, polyurethane, phenolics, silicones, and rubbers.

8. The cap of claim 1 further comprising:

a second pivot projection attached to the body on an opposite side of the body from the first pivot projection, the second pivot projection being configured to engage with a second aperture in the IDC block.

9. The cap of claim 1 further comprising:

a recess in the pivot portion of the body, the recess being configured to receive an electrical conductor; and a releasable securing mechanism extending from the cover portion of the cap and configured to engage with the IDC block to releaseably fix the cap in a closed position.

10. An insulation displacement connector (IDC) block comprising:

a plurality of adjacent housings, each housing comprising:

a cavity for receiving an IDC element; and a wall defining a part of the cavity and including an aperture; and a first cap connected to each housing and movable between a closed position and an open position with respect to the housing, wherein at least one first cap is replaced by a second cap, the second cap including an adjustable width and comprising:

a body including a pivot portion and a cover portion; and a pivot projection attached to the body, wherein at least one of the body and the pivot projection is manipulability in order to adjust the width of the second cap, wherein the pivot projection disposed on the second cap is formed of a flexible material and disposed in a first position and wherein the pivot projection of is adapted to flex toward the body to a second position to decrease the width of the second cap.

11. The insulation displacement connector block of claim 10 wherein the cover portion and pivot portion of the body of the second cap are an integral unit.

12. The insulation displacement connector block of claim 10 wherein the body of the second cap is at least partially formed of a material selected from a group consisting of a polyether imide resin; a polybutylene terephthalate (PBT) resin flame retardant, 30% glass fiber reinforced material; a polyarylamide resin, flame retardant, 30% glass fiber reinforced material; and a polyarylamide resin, flame retardant, 50% glass fiber reinforced material, filled and unfilled acetals, acrylics, acetates, cellulose derivatives, fluoropolymers, liquid crystal polymers, polyamides, polyimides, polyarylsulfones, polybenzimidazoles, polycarbonates, polyolefins, polyesters, polyethers, polyketones, polyetheretherketones, polyetherimides, polyethersulfones, polyphenylether, polyphenylsulfone, polyurethane, phenolics, silicones, and rubbers.

13. The insulation displacement connector block of claim 10 wherein the second cap is capable of being removed from the IDC block by disengaging the pivot projection from the aperture in the wall of the housing.

14. The insulation displacement connector block of claim 10 wherein the second cap further comprises:

a recess in the pivot portion of the body, the recess being configured to receive an electrical conductor; and a releasable securing mechanism extending from the cover portion of the second cap and configured to engage with the IDC block to releaseably fix the second cap in the closed position.

15. The insulation displacement connector block of claim 14 wherein the cavity further comprises:

a cutting edge adjacent to the recess in the pivot portion of the body of the second cap.

16. The insulation displacement connector block of claim 10 wherein the second cap further comprises:

at least one guide on the cover portion of the second cap aligned to engage an electrical conductor, the guide aligning the electrical conductor with the IDC element when the second cap is moved toward the closed position; and a protrusion on the cover portion adjacent the guide and aligned with an insulation displacement slot within the IDC element, the protrusion urging the electrical conductor into the insulation displacement slot within the IDC element when the second cap is moved toward the closed position.

17. The insulation displacement connector block of claim 10 further comprising a sealant material disposed within the cavity of the housing.

18. The insulation displacement connector block of claim 17 wherein sealant material is selected from a group consisting of: plasticized thermoplastic elastomers, cross-linked silicones, oil-swollen cross-linked polyurethanes or ureas, and oil-swollen polyesters.

19. A kit comprising components for assembly into an insulation displacement connector (IDC) block, the kit comprising:

a first modular cap including a first width and configured to pivotally connect to the IDC block, the first modular cap comprising:

a first body; and a first pivot projection extending from the first body and biased away from the first body for pivotally connecting and engaging the first body to the IDC block, wherein the first projection of the first modular cap is formed of a flexible material and wherein the first pivot projection is adapted to flex toward the first body to decrease the width of the first modular cap; and a second modular cap including a second width and configured to pivotally connect to the IDC block, wherein the second modular cap having an adjustable width comprises:

a second body; and a second pivot projection extending from the second body and biased away from the second body for pivotally connecting and engaging the second body to the IDC block, wherein the first modular cap is detachable from IDC block by compressing the first body in order to adjust the first width of the first cap, wherein the second pivot projection of the second modular cap is formed of a flexible material and is adapted to flex toward the second body to a second position to decrease the width of the second modular cap; and wherein the second modular cap is subsequently connected to the IDC block to replace the first modular cap by engaging the second pivot projection to the IDC block by compressing the second body in order to adjust the second width of the second cap.

20. A method of replacing a first cap pivotally connected to an insulation displacement connector (IDC) block, wherein the first cap includes a first body and a first pivot projection extending from the first body and biased away from the first body, the first pivot projection being connected to the first body and configured to engage with the IDC block, the method comprising:

removing the first cap by disengaging the first pivot projection by compressing the first body and moving the pivot projection with respect to the IDC block, thereby resulting in a void in the IDC block; and subsequently replacing the first cap with a second cap, the second cap including a second body and second pivot projection extending from the second body and biased away from the second body, the second pivot projection being connected to the second body and configured to engage with the IDC block, wherein the second pivot projection of the second modular cap is formed of a flexible material and is adapted to flex toward the second body to a second position to decrease the width of the second modular cap and wherein the second cap is positioned in the void and connected to the IDC block by engaging the second pivot projection for pivotally connecting the second body to the IDC block with the IDC block.

21. The method of claim 20 wherein the first pivot projection is rigid and the first body includes a first socket into which the first pivot projection is movable and wherein the second pivot projection is rigid and the second body includes a second socket into which the second pivot projection is movable.

22. The method of claim 20 wherein the second cap connects to a housing of the IDC block and the method further comprises introducing a sealant material into the housing of the IDC block.

23. The method of claim 22 wherein the sealant material is selected from a group consisting of: plasticized thermoplastic elastomers, cross-linked silicones, oil-swollen cross-linked polyurethanes or ureas, and oil-swollen polyesters.

* * * * *